United States Patent [19]

Craig, Jr. et al.

[11] 4,127,597

[45] Nov. 28, 1978

[54] CONTINUOUS FRACTIONATION OF TALLOW AND PRODUCTION OF A COCOA BUTTER-LIKE PLASTIC FAT

[75] Inventors: James C. Craig, Jr., Maple Glen; Michael F. Kozempel, Warminster; Stanley Elias, Elkins Park, all of Pa.

[73] Assignee: The United States of America as represented by the Secretary of Agriculture, Washington, D.C.

[21] Appl. No.: 787,660

[22] Filed: Apr. 14, 1977

[51] Int. Cl.[2] ..... C11B 7/00; C11B 3/00

[52] U.S. Cl. ..... 260/428.5; 426/607; 426/608

[58] Field of Search ..... 260/428.5, 428, 420, 260/207; 426/606, 607, 608, 429, 417

[56] References Cited

U.S. PATENT DOCUMENTS

| | | | |
|---|---|---|---|
| 2,942,984 | 6/1960 | Wissebach | 260/428.5 |
| 2,975,061 | 3/1961 | Soeters et al. | 426/607 |
| 2,975,062 | 3/1961 | Soeters et al. | 426/607 |
| 3,541,123 | 11/1970 | Kawada et al. | 260/428.5 |
| 3,755,390 | 8/1973 | Viarengo | 260/428.5 |
| 3,944,585 | 3/1976 | Luddy et al. | 260/428.5 |

*Primary Examiner*—Winston A. Douglas
*Assistant Examiner*—P. E. Konopka
*Attorney, Agent, or Firm*—M. Howard Silverstein; William E. Scott; David G. McConnell

[57] ABSTRACT

Edible tallow is continuously processed through a crystallizing system to produce three fractions, one of which has physical and thermal properties like those of cocoa butter. Nominal residence time of the crystallizing solution in the system at steady state crystallizing temperature is less than ten minutes.

4 Claims, 1 Drawing Figure

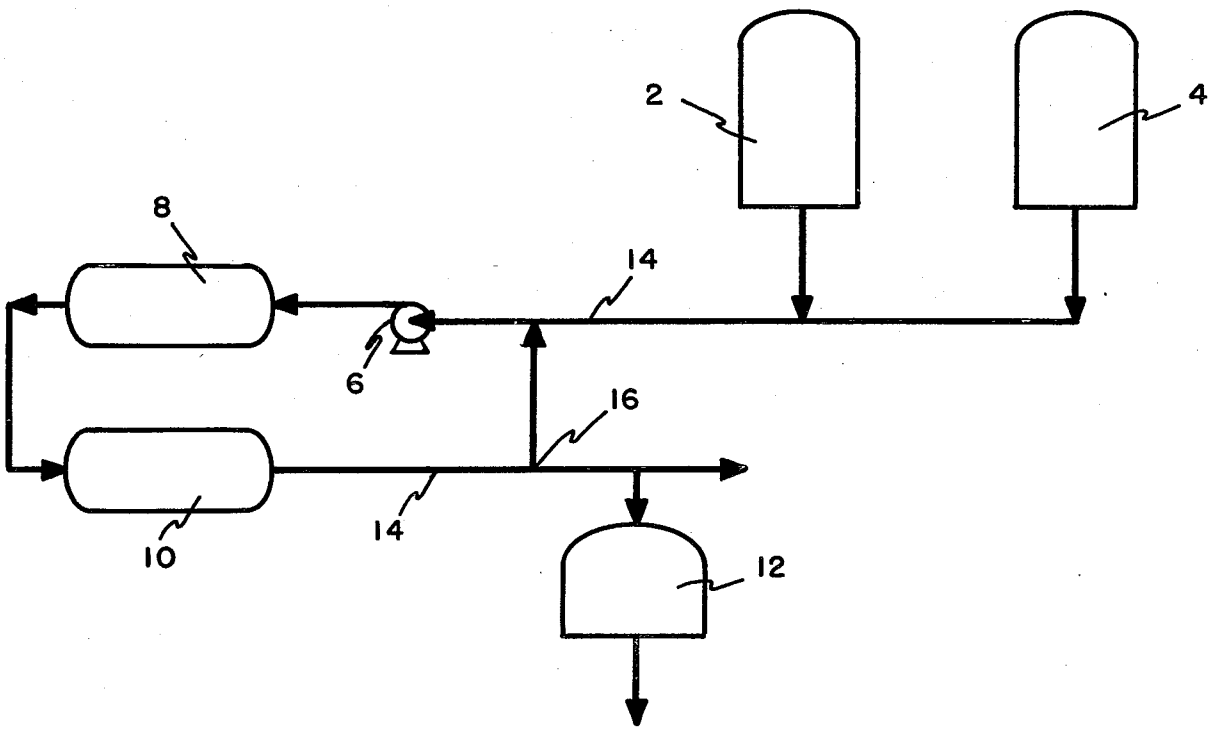
4
2
14
16
6
8
10
14
12

CONTINUOUS FRACTIONATION OF TALLOW AND PRODUCTION OF A COCOA BUTTER-LIKE PLASTIC FAT

BACKGROUND OF THE INVENTION

1. Field of the Invention

This invention relates to a continuous process for fractionating tallow and more specifically, to a continuous process for fractionating tallow into three fractions, namely, a cocoa butter-like fat, a liquid oil fraction, and a hard, high-melting fraction.

2. Description of the Prior Art

The most pertinent prior art is Luddy et al., U.S. Pat. No. 3,944,585, in which tallow was partitioned into five fractions in a multi-step batch type crystallization. Each of the four crystallizations necessary to obtain five fractions required from 16 to 20 hours.

SUMMARY OF THE INVENTION

It is an object of this invention to provide a continuous process for fractionating tallow into three distinct fractions.

Another object of this invention is to provide a process for fractionating tallow in which the nominal crystallization time at steady state crystallization temperature is less than 10 minutes.

A further object is to fractionate tallow into three distinct fractions, one of which has physical and thermal properties similar to those of cocoa butter.

In general, according to this invention, tallow is fractionated into three distinct fractions, namely, a hard high melting solid fraction, a plastic solid having physical and thermal properties similar to those of cocoa butter, and a liquid oil fraction, by either of two crystallization schemes. Tallow is dissolved in a suitable solvent, the solution is fed to one or more crystallizers and circulated through the crystallizers at a preselected steady state crystallization temperature range, and the solution filtered to obtain, depending on the temperature range, a hard, high-melting solid or a combination of a hard, high-melting solid and a plastic solid having physical and thermal properties similar to those of cocoa butter. When the process is operated to this stage according to a first crystallization scheme, the product is a hard, high-melting solid. The filtrate from the crystallization of the hard, high-melting solid is circulated through the crystallizers at a preselected steady state crystallization temperature range to crystallize out a plastic solid having physical and thermal properties similar to those of cocoa butter, and the solvent is removed from the filtrate of the latter crystallization to obtain a liquid oil fraction. When the process, prior to the first crystallization, is operated according to a second crystallization scheme, the precipitate of the first crystallization is a combination of a hard, high-melting solid and a plastic solid having physical and thermal properties similar to those of cocoa butter. The solvent is removed from the filtrate of the crystallization of the combination product to obtain a liquid oil fraction. The combined precipitate is redissolved in suitable solvent, the solution fed to one or more crystallizers and circulated through the crystallizers at a preselected steady state crystallization temperature range to crystallize out a hard, high-melting solid fraction. Solvent is removed from the filtrate of this second crystallization to obtain a plastic solid having physical and thermal properties similar to those of cocoa butter. The process is provided with means for continuously feeding solubilized tallow to the crystallizers, for continuously removing crystallized product, and for limiting the nominal residence time of a solution in the crystallizers at any preselected steady state crystallization temperature to ten minutes or less. Even though a unique feature of this invention is the fact that the nominal residence time of a solution in the crystallizers can be limited to ten minutes or less, the nominal residence time may also be longer than ten minutes if so desired or if it is more suitable or convenient.

BRIEF DESCRIPTION OF THE INVENTION

The FIGURE is a schematic outline of the process of this invention.

DETAILED DESCRIPTION OF THE INVENTION

A known weight of edible tallow is placed in a feed kettle or other container with about eight to ten times its weight of a suitable solvent. For the purposes of this invention, acetone, ACS grade, is used. The mixture is heated until the internal pressure is approximately 5 psig and agitated until it is mixed and the tallow completely solubilized. The solubilized tallow is then processed by either of two crystallization schemes.

In the first scheme the solution is fed into a system which includes a centrifugal or other suitable pump and one or more crystallizers.

For the purposes of this invention, shell and tube heat exchangers were used as crystallizers in Examples 1–4. Scraped surface heat exchangers were used as crystallizers in all the other examples. Temperature within the crystallizers is regulated by circulating coolant around their outside surfaces. When the system temperature reaches about 59°–68° F., the circulating solution stream is split so that part of the solution is fed to a filter while the remainder is recirculated. As material is withdrawn from the system through the filter, fresh solution is fed into the system from the feed kettle. The flow of coolant around the crystallizers is adjusted to keep the solution stream at about 59°–68° F. A hard, high-melting solid is collected on the filter. Pressure in the filter at this stage is less than about 25 psig. When all of the solution has been fed into the system and a predetermined quantity of filtrate is collected, the outlet of the solution feed kettle is closed and that of a wash kettle containing acetone is opened to the system. The acetone is cooled to about the same temperature as the process system. The filter cake is washed until a predetermined quantity of wash solution is collected. The wash solution, collected separately from the filtrate, is evaporated to recover the acetone. The filtrate is loaded into the now empty and cooled feed kettle. The filtrate is fed into the system and the continuous feed/withdrawal process described above is repeated, except that the process stream temperature is maintained at about 34°–44° F. A plastic solid having physical and thermal properties similar to those of cocoa butter is collected as a precipitate in the filter. The precipitate is washed as described above. A liquid oil fraction is obtained by removing the solvent from the filtrate.

The second crystallization scheme is the same as the first one just described except that the crystallizations are carried out in reverse order. The first crystallization is carried out at about 34°–44° F. and produces, as a precipitate, a combination of a hard, high-melting solid and a plastic solid having physical and thermal properties similar to those of cocoa butter. The filter cake is washed as described above, collected, and put into the empty feed kettle with a volume of acetone equal to that in the oil-containing filtrate. After the filter cake is solubilized with acetone, it is fed into the system and continuously crystallized, as heretofore described, at about 59°–68° F. A hard, high-melting solid is obtained as the precipitate and a plastic solid having physical and thermal properties similar to those of cocoa butter is recovered from the filtrate.

The products of both crystallization schemes are the same and are described in order of decreasing yield:

1. An oil, liquid at room temperature (ca 70° F.) and solid when refrigerated. The oil is recovered as 65 ± 5% (wb) of the starting material.

2. A white, hard, high-melting solid that melts at about 50° C. This fraction is recovered as about 20 ± 10% (wb) of the starting material.

3. A plastic fat, white to pale yellow in color which is solid at or below room temperature and melts sharply at body temperature (37° C.). This fraction has physical and thermal properties similar to those of cocoa butter and may be used as a cocoa butter replacement or extender. This fraction is recovered as 5–30% (wb) of the starting material.

The invention is illustrated by the following examples with reference to the FIGURE:

EXAMPLE 1

2837 gm of edible tallow were placed in 20 gallon, jacketed, glass lined, kettle 2 which was fitted with a top sight glass, a thermocouple well and an anchor-type agitator. Enough acetone was added to solubilize the tallow and make a solution of 8.7 parts acetone and 1 part tallow by weight. The solution was fed to the system from kettle 2 through line 14 and pumped by centrifugal pump 6 through crystallizers 8 and 10 and recirculated. Cooling medium was run through the outside shell of crystallizers 8 and 10 and filter 12. When the circulating solution in the system reached a steady state temperature of about 67° F., the solution was split at junction 16 so that part of the solution was fed to filter 12 and part recirculated through the crystallizing system. As some of the solution was withdrawn through filter 12, fresh solution was fed into the system from kettle 2. The steady state temperature of the circulating solution at about 67° F. was maintained until all of the solution had been fed into the system, crystallized and filtered. The filter cake was washed with acetone from kettle 4. The yield of this first precipitate, the hard, high-melting solid, was about 25% of the original tallow. The concentration of the original feed was 10.3% fat on a weight basis and that of the filtrate was 7.5–7.7% (wb).

The filtrate, which was now about 12.1 parts acetone to 1 part uncrystallized tallow or about 7.6% fat concentration by weight, was transferred into kettle 2 and fed to the crystallizing system as described above except that the steady state temperature was now 43° ± 1° F. After all of the filtrate had been fed into the system from kettle 2, acetone wash solvent was pumped from kettle 4 to wash the filter cake, the yield of which represented about 14% of the original tallow. This second precipitate is the plastic fat that is similar to cocoa butter. After tempering at 68° F., the thermal properties of this fraction as measured by differential scanning calorimetry (DSC) indicated that it was an excellent replacement for cocoa butter. Solvent was removed from the filtrate to recover the liquid oil fraction. The yield was calculated to be about 61%.

EXAMPLE 2

Edible tallow was dissolved in acetone at a 9.2% weight concentration (9.84 parts acetone to 1 part tallow). The procedure described in Example 1 was followed. The first crystallization was made at a steady state temperature of about 67° ± 1° F. and the hard, high-melting fraction collected (yield, about 18%). The filtrate, the concentration of which was about 7.3–7.6% by weight (about 12.2 parts acetone to 1 part solute), was then crystallized as in Example 1 at a steady state temperature of about 43° ± 1° F. After all of the tallow solution had been fed into the system and processed, acetone wash solvent was pumped into the system to wash the precipitate filter cake. The precipitate, yield about 17%, was tempered at 68° F. and analyzed. DSC indicated that it was an excellent replacement for cocoa butter. Solvent was removed from the filtrate of the second crystallization to obtain a liquid oil fraction. The yield was calculated to about 65%.

EXAMPLE 3

2824 gm edible tallow were dissolved in acetone in kettle 2 to make a solution of 7.6 parts acetone to 1 part tallow by weight or a weight concentration of 11.7%. The processing was essentially the same as in Examples 1 and 2 except that the order or crystallizations was reversed. The first crystallization was carried out at a steady state temperature of about 41° F. The first precipitate was a combination of the hard, high-melting fraction and the fraction having properties similar to those of cocoa butter. The liquid oil fraction was recovered from the filtrate. The combined precipitate was redissolved in acetone to make a solution of about 30.1 parts acetone to 1 part solute by weight or a weight concentration of about 3.2%. This solution was fed through the system including crystallizers 8 and 10 and crystallized at a steady state temperature of about 67° F. and then filtered through filter 12. When all of the solution from kettle 2 had been put through the system, the precipitate (the hard, high-melting fraction) was washed with acetone from kettle 4. The plastic fat fraction was recovered from the filtrate. After tempering at 68° F., the plastic fat fraction was analyzed by DSC. The analysis indicated that this fraction was an excellent replacement for cocoa butter.

EXAMPLE 4

Edible tallow was dissolved in acetone to make a solution of 9.95 parts acetone to 1 part tallow by weight or a weight concentration of 9.1%. Processing was the same as in Example 3. The first crystallization was carried out at a steady state temperature of about 38°–42° F. The precipitate from the first crystallization was redissolved in acetone to make a solution of about 30 parts acetone to 1 part solute by weight or a weight concentration of 3.7%, and then crystallized as in the foregoing examples at a steady state temperature of about 67° F. After tempering the plastic fat fraction at 68° F., it was indicated by DSC to be a good replacement for cocoa butter.

EXAMPLE 5

3318 gm of edible tallow were dissolved in 33180 gm acetone in kettle 2 to make a solution of 10 parts acetone to 1 part tallow by weight. The procedure was essentially as described in Example 1 and 2. The first crystallization was made when the steady state crystallization temperature in crystallizers 8 and 10 was about 65° F. At this stage, the temperature of the process stream in filter 12 was 53° F. The yield of this precipitate, the hard, high-melting solid, was about 18.1%. The filtrate from the first crystallization, the concentration of which was 7.5%, was transferred to kettle 2 and processed through the system at a steady state crystallization temperature of about 43° F. in crystallizers 8 and 10. The temperature of the process stream in filter 12 at this time was about 34° F. The precipitate from this crystallization, a plastic fat resembling cocoa butter, was tempered at 68° F. DSC indicated that the plastic fat was an excellent replacement for cocoa butter. Yield of this fraction was about 13.7%. Solvent was removed from the filtrate to obtain a liquid oil fraction. The yield was calculated to be about 68.1%.

EXAMPLE 6

3432 gm of edible tallow were dissolved in 34320 gm acetone in kettle 2 to make a solution of 10 parts acetone to 1 part tallow by weight. The procedure was essentially the same as in Example 5 except that the first crystallization was made at a steady state temperature of about 61° F. in crystallizers 8 and 10. The temperature of the filtrate from filter 12 was 61° F. Yield of hard, high-melting solid was about 17.5%. Filtrate concentration was about 7.5%. The filtrate was crystallized as in Example 5 at a steady state temperature of about 38° F. in crystallizers 8 and 10. Filtrate temperature was about 39° F. Yield of plastic fat fraction was about 19.8%. After tempering at about 68° F., DSC indicated that the plastic fat fraction was an excellent replacement for cocoa butter. Solvent was removed from the filtrate (concentration 5.7%) to yield about 62.6% liquid oil fraction.

EXAMPLE 7

4566 gm of edible tallow were dissolved in 45660 gm acetone in kettle 2 to make a solution of 10 parts acetone to 1 part tallow by weight. The procedure was essentially the same as in Example 5. The first crystallization was made at a steady state temperature of about 62° F. in crystallizers 8 and 10. The temperature of the filtrate from filter 12 was 62° F. Yield of hard, high-melting solid was 17.7%. The filtrate, concentration about 7.9–8.0%, was transferred to kettle 2 and crystallized as above at a steady state temperature in the crystallizers of about 38° F. Temperature of the filtrate from filter 12 was about 39° F. Yield of plastic fat was 18.2%. After tempering at 68° F., DSC indicated that the plastic fat was an excellent replacement for cocoa butter. The filtrate from the crystallization at 38° F. had a concentration of about 6.1–6.2%. Solvent was removed from the filtrate to yield 64.1% liquid oil fraction.

Although the continuous process of this invention is limited to two crystallizations and three products whereas that of the most pertinent prior art (U.S. Pat. No. 3,944,585) uses four crystallizations to produce five products, the plastic fat fraction of this invention exhibits the same physical and thermal properties as those of fraction 3 of the Luddy et al. patent. By DSC, the plastic fat of this invention is shown to be an excellent fat to use as a cocoa butter substitute or extender.

The outstanding difference between the process of this invention and that of Luddy et al. is the time required to complete the processing. In the Luddy et al. process, each crystallization requires about 16–20 hours so that the process requires almost a full week to complete. In the process of this invention, actual crystallization time of any particular portion of the solution at steady state crystallization temperature is 10 minutes or less. Certainly, one skilled in the art having a knowlege of the Luddy et al. process would not expect such a highly turbulent, continuous process to produce fractions having the distinct properties exhibited by the three fractions of this invention. It was especially unpredictable that one of the fractions would be a plastic fat having physical and thermal properties like those of cocoa butter.

Although the invention has been exemplified using only one solvent, acetone, other solvents can undoubtedly be used with equal success. Since, in operations involving solutes and solvents, solubility depends on concentration and temperature, an infinite number of combinations of solvent, concentration and temperature are possible in the process of this invention.

We claim:

1. A process for fractionating tallow into three distinct fractions, a hard, high-melting solid fraction, a plastic solid having physical and thermal properties similar to those of cocoa butter, and a liquid oil fraction, comprising;

(a) dissolving the tallow in a suitable solvent, the ratio of solvent to tallow being sufficient to solubilize the tallow and to effect a fractionation at a crystallizable ratio of solute concentration and temperature;

(b) feeding, continuously, the solution to one or more crystallizers;

(c) circulating the solution through the crystallizers at a first preselected steady state crystallization temperature range;

(d) limiting the nominal residence time of said solution in the crystallizers at said first steady state crystallization temperature to a maximum of ten minutes;

(e) crystallizing out a hard, high-melting solid thereby forming a circulating crystallized stream;

(f) withdrawing continuously part of said crystallized stream at said first preselected steady state crystallization temperature to obtain crystallized hard, high-melting solid and filtrate;

(g) recirculating, continuously, at said first preselected steady state crystallization temperature, the crystallized stream not withdrawn in step (f) together with aforesaid continuously fed solubilized tallow;

(h) repeating steps (f) and (g) until all of the solublized tallow is fed to the crystallizers and all of said crystallized stream is withdrawn from the crystallizers;

(i) circulating the filtrate from the aforesaid first crystallization through said crystallizers at a second preselected steady state crystallization temperature range;

(j) limiting the nominal residence time of said filtrate solution in the crystallizers at the steady state crystallization temperature to a maximum of 10 minutes;

(k) crystallizing out a plastic solid having physical and thermal properties similar to those of cocoa butter thereby forming a circulating crystallized stream;

(l) withdrawing continuously part of said crystallized stream at said second preselected steady state crystallization temperature to obtain crystallized plastic solid and filtrate;

(m) recirculating, continuously, at said second preselected steady state crystallization temperature, the crystallized stream not withdrawn in step (l);

(n) repeating steps (l) and (m) until all of said crystallized stream is withdrawn from the crystallizers; and (o) removing the solvent from the filtrate from the aforesaid second crystallization to obtain a liquid oil fraction.

2. A process for fractionating tallow into three distinct fractions, a hard, high-melting solid fraction, a plastic solid having physical and thermal properties similar to those of cocoa butter, and a liquid oil fraction, comprising;

(a) dissolving the tallow in a suitable solvent, the ratio of solvent to tallow being sufficient to solubilize the tallow and to effect a fractionation at a crystallizable ratio of solute concentration and temperature;

(b) feeding, continuously, the solution to one or more crystallizers;

(c) circulating the solution through the crystallizers at a first preselected steady state crystallization temperature range;

(d) limiting the nominal residence time of said solution in the crystallizers at said first steady state crystallization temperature to a maximum of 10 minutes;

(e) crystallizing out a precipitate, said precipitate being a combination of the hard, high-melting solid fraction and the plastic solid fraction thereby forming a circulating crystallized stream;

(f) withdrawing, continuously, part of said crystallized stream at said first preselected steady state crystallization temperature to obtain said combination of crystallized fractions and filtrate.

(g) recirculating, continuously, at said first preselected steady state crystallization temperature the crystallized stream not withdrawn in step (f) together with aforesaid continuously fed solubilized tallow;

(h) repeating steps (f) and (g) until all of the solubilized tallow is fed to the crystallizers and all of said crystallized stream is withdrawn from the crystallizers;

(i) removing the solvent from the filtrate of the aforesaid precipitate to obtain the liquid oil fraction;

(j) redissolving the aforesaid precipitate in a suitable solvent, the ratio of solvent to tallow being sufficient to solubilize the tallow and to effect a fractionation at a crystallizable ratio of solute concentration and temperature;

(k) feeding, continuously, the solution to one or more crystallizers;

(l) circulating the solution through the crystallizers at a second preselected steady state crystallization temperature range;

(m) limiting the nominal residence time of the solution in the crystallizers at said second steady state crystallization temperature to a maximum of ten minutes;

(n) crystallizing out a hard, high-melting solid fraction, thereby forming a circulating crystallized stream;

(o) withdrawing continuously part of said crystallized stream at said second preselected steady state crystallization temperature to obtain crystallized hard, high melting solid and filtrate;

(p) recirculating, continuously, at said second preselected steady state crystallization temperature the crystallized stream not withdrawn in step (o);

(q) repeating steps (o) and (p) until all of said crystallized stream is withdrawn from the crystallizers; and (r) removing the solvent from the filtrate of the solid fraction to obtain a plastic solid having physical and thermal properties similar to those of cocoa butter.

3. A process for fractionating tallow into three distinct fractions, a hard high-melting solid first fraction, a plastic solid second fraction having physical and thermal properties similar to those of cocoa butter, and a liquid oil third fraction, comprising the steps of:

(a) dissolving the tallow in a suitable solvent at a ratio of about 8 to 10 parts solvent to 1 part tallow;

(b) feeding, continuously, the solution of step (a) to one or more crystallizers;

(c) circulating, continuously, the fed solution through the crystallizers until a steady state crystallization temperature of about 59°–68° F. is reached;

(d) limiting the nominal residence time of the solution in the crystallizers at said steady state crystallization temperature to a maximum of ten minutes;

(e) crystallizing out a hard, high-melting solid thereby forming a circulating crystallized stream;

(f) withdrawing, continuously, part of said crystallized stream at said steady state crystallization temperature of about 59°–68° F. to obtain crystallized hard, high-melting solid and filtrate;

(g) recirculating, continuously, at the aforesaid steady state crystallization temperature, the crystallized stream not withdrawn in step (f) together with aforesaid continuously fed solubilized tallow;

(h) repeating steps (f) and (g) until all of the solubilized tallow is fed to the crystallizers and all of said crystallized stream is withdrawn from the crystallizers;

(i) circulating the filtrate from the aforesaid crystallization through said crystallizers at a steady state crystallization temperature of about 34°–44° F.

(j) limiting the nominal residence time of the filtrate solution in the crystallizers at the steady state temperature of about 34°–44° F. to a maximum of 10 minutes;

(k) crystallizing out a plastic solid having physical and thermal properties similar to those of cocoa butter thereby forming a circulating crystallized stream;

(l) withdrawing, continuously, part of said crystallized stream at said steady state temperature of about 34°–44° F. to obtain said plastic solid and filtrate;

(m) recirculating, continuously, at said steady state crystallization temperature of about 34°–44° F. the crystallized stream not withdrawn in step (l);

(n) repeating steps (l) and (m) until all of said crystallized stream is withdrawn from the crystallizers; and (o) removing the solvent from the filtrate of the aforesaid crystallization at about 34°–44° F. to obtain a liquid oil fraction.

4. A process for fractionating tallow into three distinct fractions, a hard high-melting solid first fraction, a plastic solid second fraction having physical and thermal properties similar to those of cocoa butter, and a liquid oil third fraction, comprising the steps of:

(a) dissolving the tallow in a suitable solvent at a ratio of about 7 to 10 parts solvent to 1 part tallow;

(b) continuously feeding the solution of step (a) to one or more crystallizers;

(c) continuously circulating the fed solution through the crystallizers until a steady state crystallization temperature of about 34°–44° F. is reached;

(d) limiting the nominal residence time of said solution in the crystallizers at said steady state crystallization temperature to a maximum of 10 minutes;

(e) crystallizing out a combination of aforesaid first and second fractions thereby forming a circulating crystallized stream;

(f) withdrawing, continuously, part of said crystallized stream at said steady state crystallization temperature of about 34°–44° F. to obtain said combined crystallized fractions and filtrate;

(g) recirculating, continuously, at the aforesaid steady state crystallization temperature the crystallized stream not withdrawn in step (f) together with aforesaid continuously fed solubilized tallow;

(h) repeating steps (f) and (g) until all of the solubilized tallow is fed to the crystallizers and all of said crystallized stream is withdrawn from the crystallizers;

(j) removing the solvent from the filtrate of the aforesaid combined crystallized fractions to obtain the aforesaid liquid oil third fraction;

(j) redissolving the aforesaid combined crystallized fractions in a suitable solvent at a ratio of about 30 parts solvent to 1 part combined fractions;

(k) continuously feeding the solution formed in step (j) to one or more crystallizers;

(l) circulating, continuously, the fed solution through the crystallizers until a steady state crystallization temperature of about 58°–69° F. is reached;

(m) limiting the nominal residence time of the solution in the crystallizers at said steady state crystallization temperature to a maximum of ten minutes;

(n) crystallizing out a hard, high-melting solid fraction thereby forming a circulating crystallized stream;

(o) withdrawing, continuously, part of said crystallized steam at said steady state crystallization temperature of about 59°–68° F. to obtain aforesaid hard, high-melting solid first fraction and filtrate;

(p) recirculating, continuously, at said steady state crystallization temperature of about 59°–68° F. the crystallized stream not withdrawn in step (o);

(q) repeating steps (o) and (p) until all of said crystallized stream is withdrawn from the crystallizers; and (r) removing the solvent from the filtrate of the aforesaid solid first fraction to obtain the aforesaid plastic solid second fraction.

* * * * *